US005329643A

United States Patent [19]

Sato

[11] Patent Number: 5,329,643

[45] Date of Patent: Jul. 19, 1994

[54] DIVING FACE MASK

[75] Inventor: Hiromasa Sato, Zushi, Japan

[73] Assignee: Tabata Co., Ltd., Tokyo, Japan

[21] Appl. No.: 74,123

[22] Filed: Jun. 8, 1993

[30] Foreign Application Priority Data

Aug. 6, 1992 [JP] Japan ..... 4-210411

[51] Int. Cl.[5] ..... A61F 9/02

[52] U.S. Cl. ..... 2/428; 128/200.29

[58] Field of Search ..... 128/206.24, 206.21, 128/206.15, 207.12, 207.13, 200.29, 201.28; 2/428, 429, 430, 426

[56] References Cited

U.S. PATENT DOCUMENTS

| | | | |
|---|---|---|---|
| 2,435,653 | 2/1948 | Maurer | 128/207.13 |
| 3,345,984 | 10/1967 | Katehis | 128/145 |
| 3,671,976 | 6/1972 | Johnson et al. | 2/430 |
| 4,241,898 | 12/1980 | Segrest | 251/321 |
| 4,856,120 | 8/1989 | Hart | 2/428 |

FOREIGN PATENT DOCUMENTS

| | | | |
|---|---|---|---|
| 0935100 | 6/1982 | U.S.S.R. | 2/436 |

*Primary Examiner*—Peter Nerbun

*Attorney, Agent, or Firm*—Dressler, Goldsmith, Shore & Milnamow, Ltd.

[57] ABSTRACT

A diving face mask comprises a purge valve assembly in a lower central area of a body frame. The purge valve assembly comprises a nose frame projecting from the body frame such that a V-shape cross-section is formed, a laterally elongated, and generally oblong valve which is configured to sit on a valve seat on a front wall of the nose frame for closing a laterally elongated, oblong opening passage. The purge valve assembly further comprises a nose cover having a configuration conforming to that of the nose frame for covering the nose frame, and a discharge opening defined between the nose frame and the nose cover.

15 Claims, 5 Drawing Sheets

DIVING FACE MASK

TECHNICAL FIELD

The present invention relates to a diving face mask which a diver wears on his face during underwater diving activities such as skin diving or scuba diving, more particularly to such a diving face mask which is provided with a purge valve for purging or discharging accumulations of water and exhausting a diver's breath from the mask.

BACKGROUND OF THE INVENTION

Prior art diving face masks with such a purge valve generally include a cylindrical or box-shaped bulky portion which projects normally forwardly from a lower central area of a mask front surface to define a valve chamber where a valve is located (for example, see Japanese Kokai Utility Model No. Sho 49-33599). Such bulky configurations of the prior diving face masks have a poor appearance. More disadvantageously, the bulky configurations create increased fluid resistance, and in some instances, catch seaweeds therearound which may cause serious problems to a divers's underwater activities.

Another drawback of the prior diving face masks is that they are not configured to collect at their bottom planes, where the valve chamber is located, accumulations of water therein through leakage or the like. In such configurations, it is therefore difficult to completely discharge the accumulations of water from opening passages of the valve by the air pressure created through a single breathing stroke of the diver.

Still another drawback of the prior diving face masks is that they are not structurally designed to manage air bubbles formed as a diver's breath goes through the accumulations of water. Those air bubbles sometimes touch a diver's nares to give a diver discomfort or pain, or diffuse along the front lens to block the diver's view.

SUMMARY OF THE INVENTION

The present invention provides a diving face mask which comprises a body frame having a lower edge, and a curved portion upwardly contoured from the lower edge so as to define a contoured interior space for receiving a lense. The face mask further comprises a purge valve assembly forwardly projecting from the body frame. The purge valve assembly comprises a nose frame, a valve and a nose cover.

The nose frame is integrally formed with the body frame to project forwardly therefrom, and has a generally V-shaped cross-section to include intersecting first and second walls. The first wall has a front edge extending forwardly and downwardly from the curved portion of the body frame. The second wall expands between the front edge of the first wall and the lower edge of the body frame. The second wall has a valve seat and an opening passage passing through the valve seat. The valve seat is configured to receive the valve in water-tight relationship for closing the opening passage. The nose cover is disposed forwardly of the nose frame and is configured to generally conform to a configuration of the nose frame for covering a front face of the nose frame. The nose cover has a lower edge spaced from the body frame for defining a discharge opening therebetween.

Reduced bulk and height, and an arcuate top surface of the valve assembly of the diving face mask in accordance with the present invention provide reduced fluid resistance, and with the arrangement capable of eliminating the problems which an upright configuration of prior art valve assemblies causes.

In one embodiment of the present invention, the body frame comprises an inner frame which has the curved portion for receiving the lens, and an outer frame disposed radially outwardly of and engaged with the inner frame. The nose frame is integrally formed with the inner frame to forwardly project from the inner frame. The nose cover has the lower edge spaced from the outer frame for defining the discharge opening therebetween.

In another aspect of the present invention, there is provided a diving face mask which comprises a body frame having a lower edge, and a nose piece projecting from the body frame. The nose piece includes a laterally elongated, front side wall forwardly extending from the lower edge of the body frame. The front side wall has a laterally elongated, generally oblong opening passage. The nose piece further comprises a laterally elongated, generally oblong valve for closing the opening passage in water-tight manner. The nose piece may further include a detachable nose cover for covering the front side wall. Such a nose cover preferably has a lower edge spaced from the lower edge of the body frame for defining a discharge opening therebetween.

The laterally elongated configuration of both the opening passage and the valve permits a reduced height of the front side wall of the nose piece, which can be likewise configured in accommodating the opening passage and the valve therein. The reduced height provides less blockage of a diver's view through the lens. In addition, the laterally elongated, generally oblong configuration of the valve facilitates opening and closing of its longitudinal opposite ends in response to pressure of breath discharged from the diver's nose.

Other features and advantages of the present invention will become readily apparent from the following detailed description, the accompanying drawings, and the appended claims.

DETAILED DESCRIPTION

Figure 1:
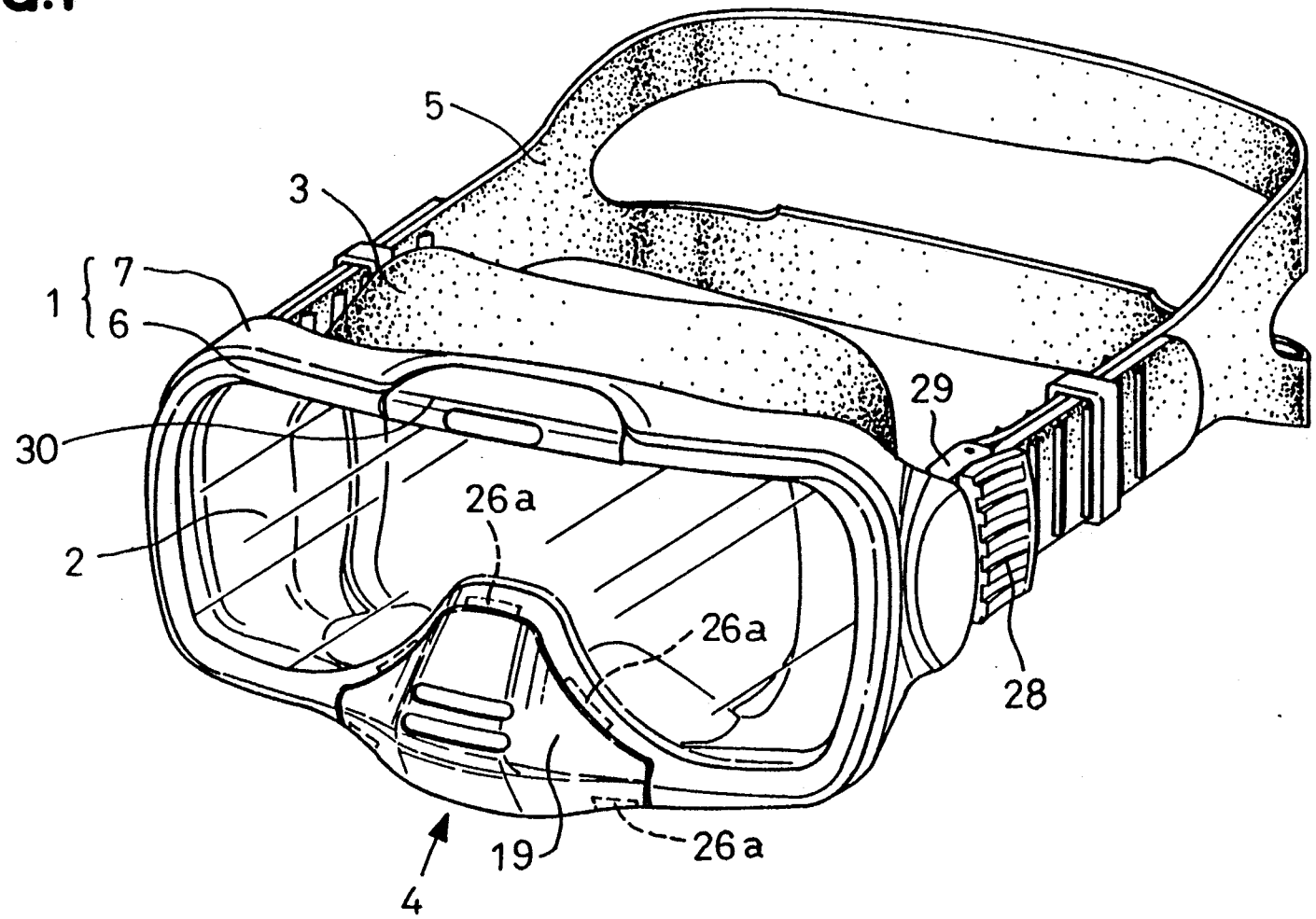
FIG. 1 is a front perspective view of a diving face mask embodying the principles of the present invention.
Figure 2:
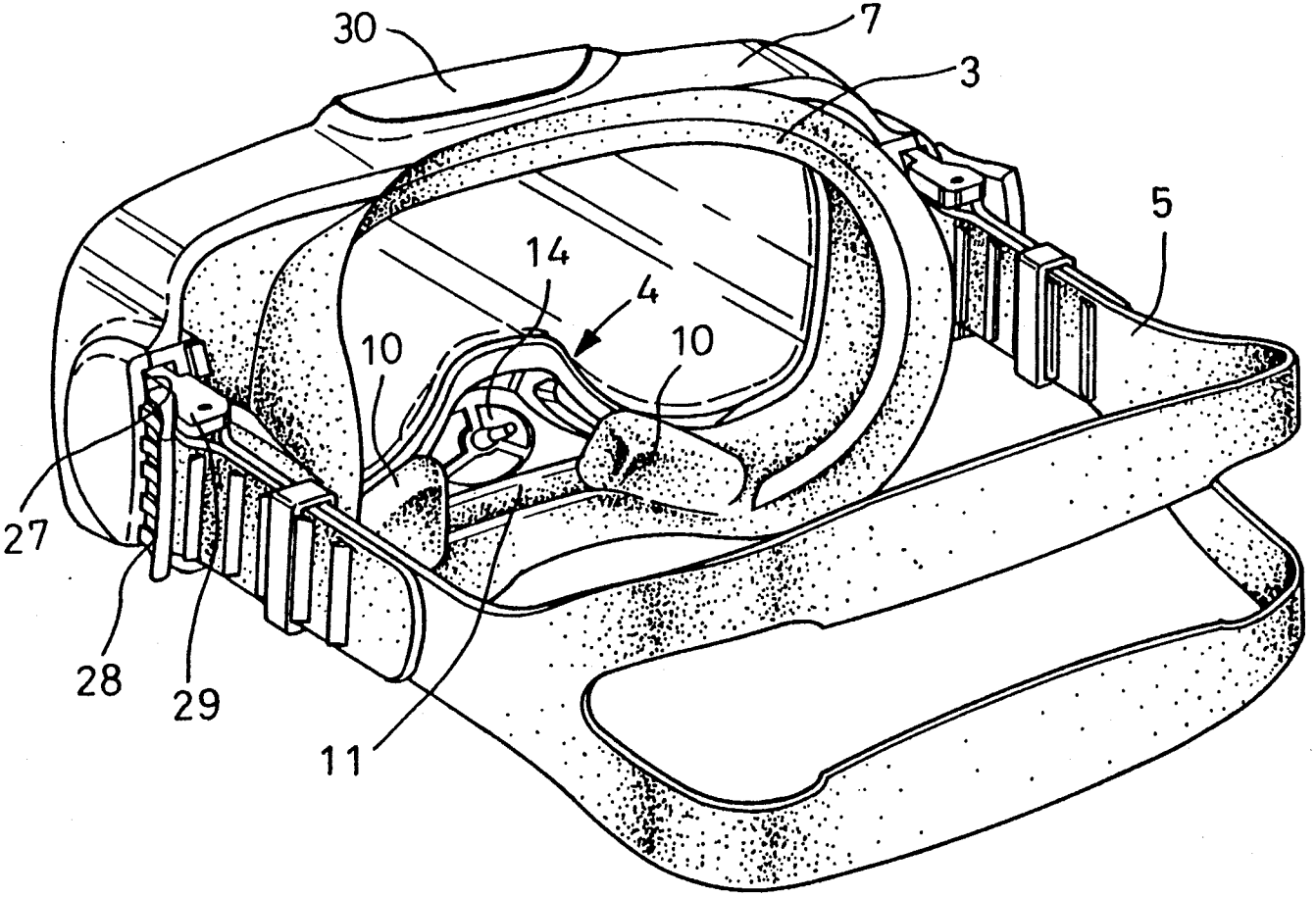
FIG. 2 is a rear perspective view of the diving face mask of FIG. 1.

While the present invention is susceptible of embodiment in various forms, there is shown in the drawing and will hereinafter be described in detail specific embodiment thereof, with the understanding that the present disclosure is to be considered as an exemplification of the principles of the invention, and is not intended to limit the invention to the specific embodiment illustrated.

Referring to FIGS. 1 through 7, there is illustrated a diving face mask embodying the principles of the present invention. The face mask generally comprises a body frame 1 of tough synthetic plastic material, a lens 2 of tough synthetic plastic material, and a flexible skirt 3 of semi-transparent rubber or synthetic plastic material. The face mask further comprises a purge valve assembly 4, and a flexible strap 5 of semi-transparent rubber or synthetic plastic material.

The body frame 1 comprises a semi-transparent inner frame 6 (also referred to as a lens frame), and a non-transparent outer frame 7 integrally molded and engaged with the inner frame 6. A collar frame 30 engages with the respective inner and outer frames 6, 7 at their upper central areas for further tightly holding them together. The lense frame 6 has at its lower center an upwardly converging curved portion 8 which includes two side portions gradually downwardly diverging from each other to define a generally triangular configuration with a round apex connecting the two side portions. The lense frame 6 further has on its inner surface a circumferentially extending internal groove 9 into which a peripheral edge portion of the lense 2 is fitted in water-tight relationship.

The flexible skirt 3 has a front peripheral edge portion which is flanked by and positioned between respective rear peripheral edge portions of the inner and outer frames 6, 7, and a rear peripheral edge portion extending rearwardly from the front peripheral edge portion. The flexible skirt 3 has on its bottom surface a pair of spaced apart, integral upward embossments to define finger-receiving pockets 10 into which a diver inserts his or her fingers from below for pinching the nose. The pair of finger-receiving pockets 10 are disposed on opposite sides of a central region of the bottom surface of the flexible skirt 3, and are spaced inwardly from a rear face of the lense frame 6 for defining an bubble channel therebetween. A bottom surface portion of the flexible skirt 3 is recessed downwardly between the pair of finger-receiving pockets 10 to form a depression region 11 having a generally V-shaped cross-section. The flexible skirt 3 is further provided with an integral, sealing ridge 12 which is disposed adjacent to and extends along the rear peripheral edge portion thereof.

Figure 3:
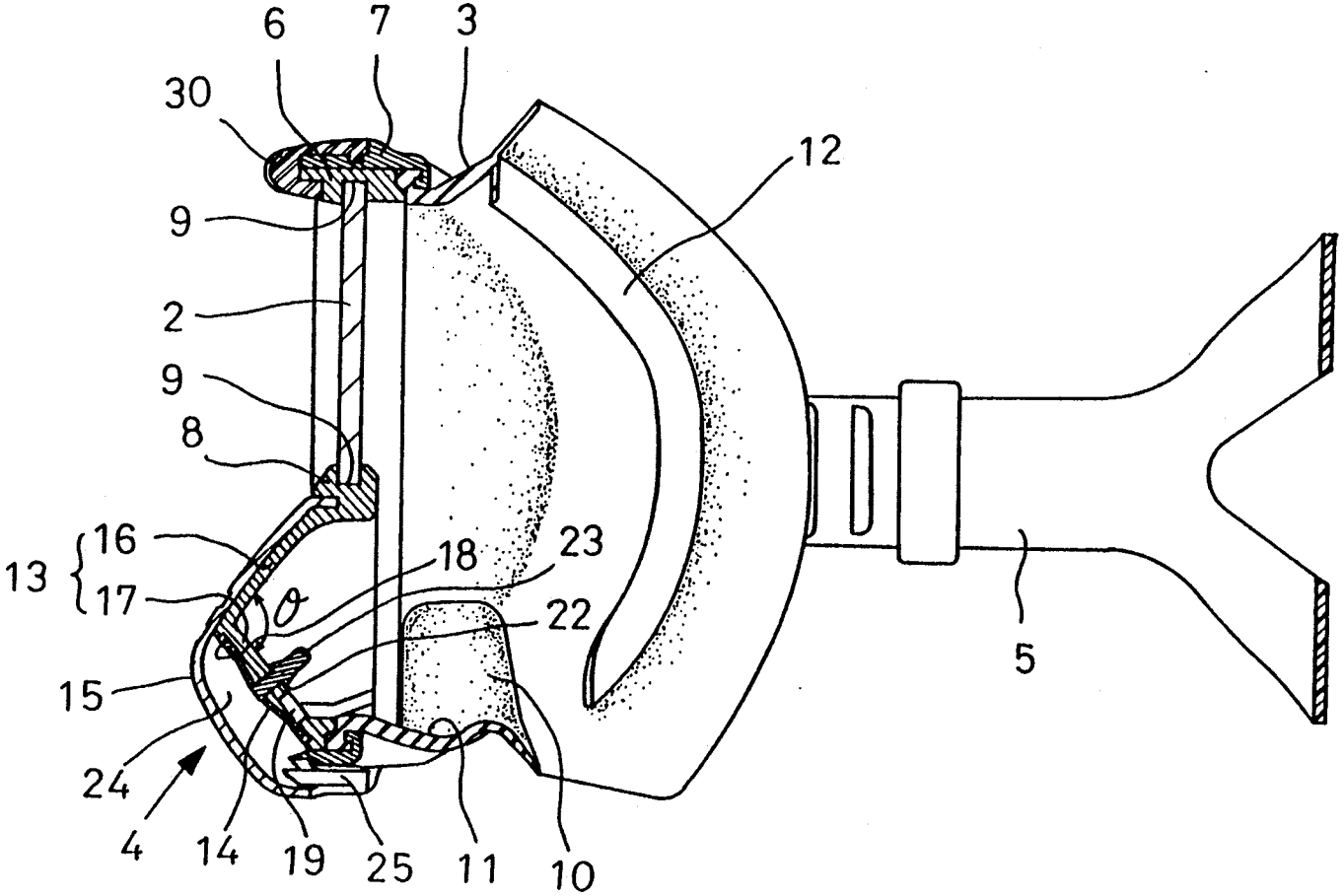
FIG. 3 is a cross-sectional view of the diving face mask, taken along a lateral center line of the mask.
Figure 4:
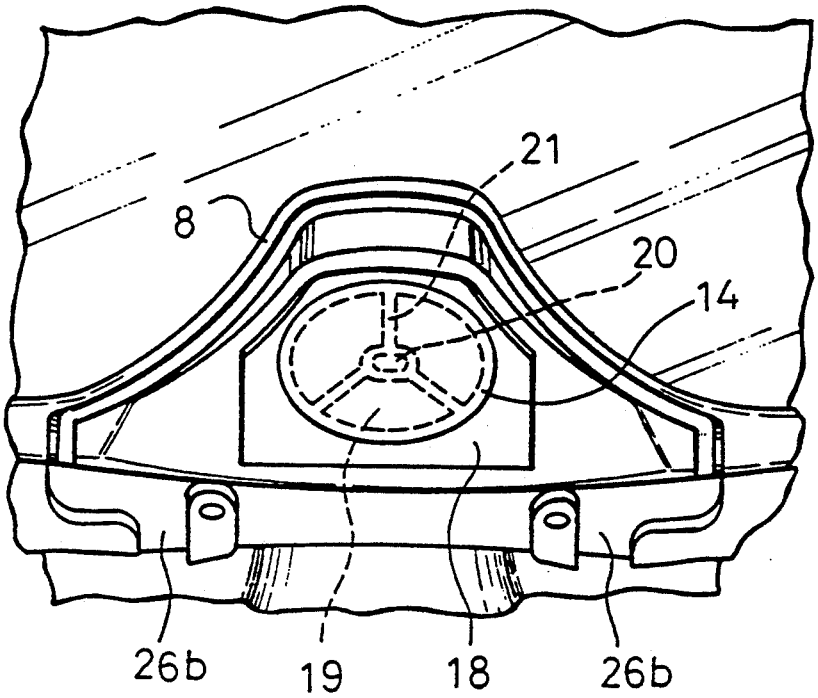
FIG. 4 is an enlarged perspective view illustrating a mask portion where a valve is mounted, with a nose cover removed therefrom.
Figure 5:
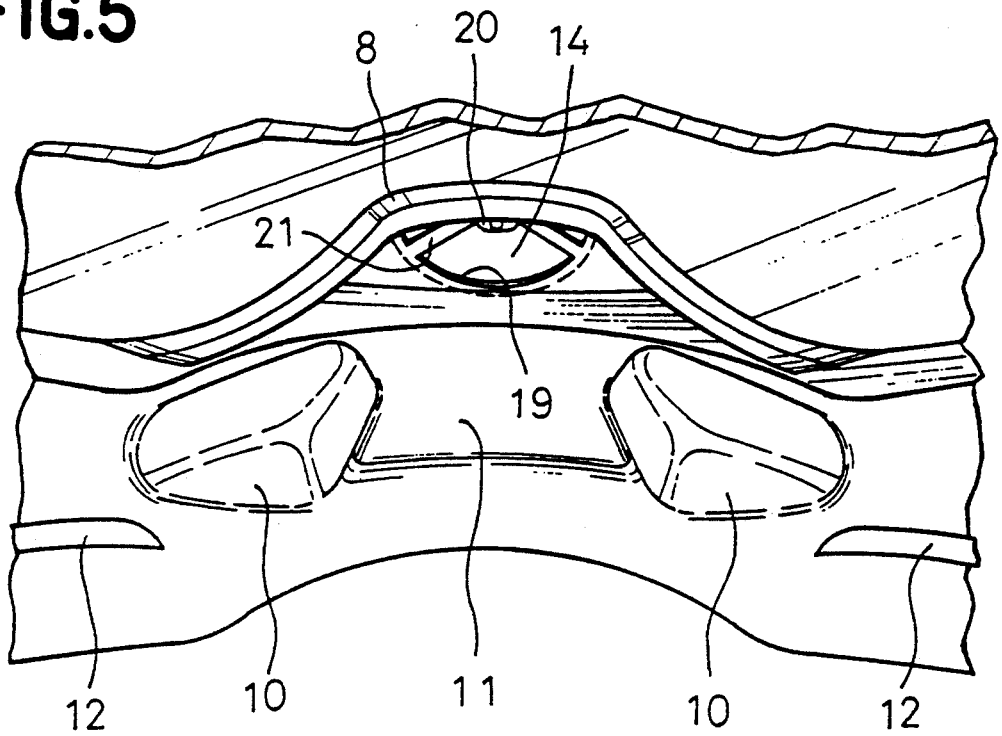
FIG. 5 is an enlarged perspective view illustrating a central bottom area of a flexible skirt.
Figure 6:
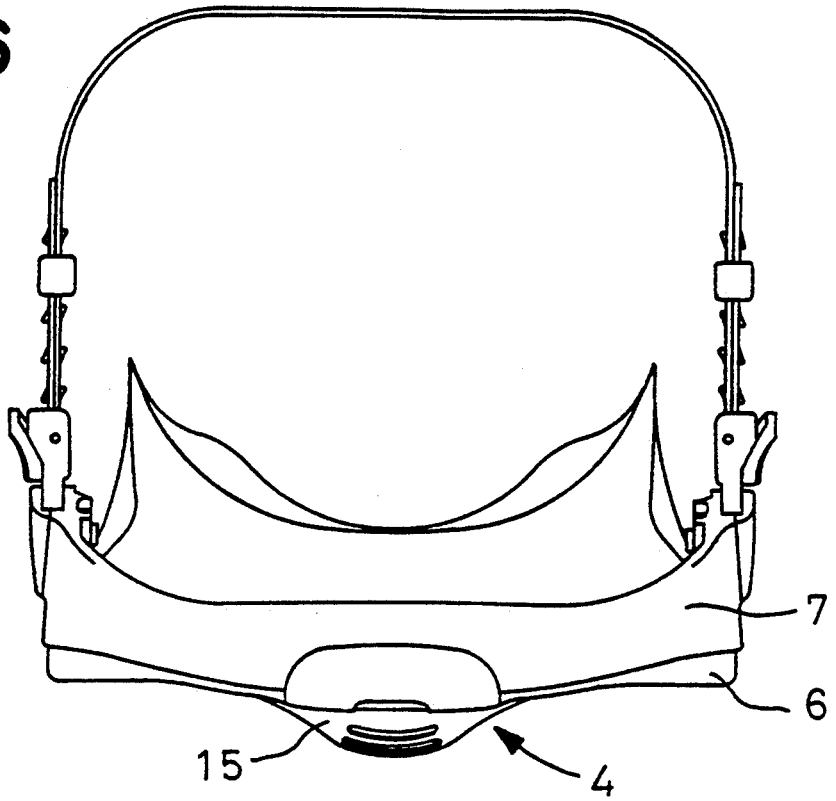
FIG. 6 is a top plan view of the diving face mask of FIG. 1.

The purge valve assembly 4 comprises a semi-transparent nose frame 13, a sheet or flat valve 14, and a semi-transparent nose cover 15 which defines a valve chamber. The nose frame 13 may be integrally molded with the lense frame 6 from the same material. The nose frame 13 projects forwardly from the curved portion 8 to extend beyond the lense frame 6. The nose frame 13 has a generally V-shaped longitudinal cross-section to include a forwardly inclined upper wall 16, and a rearwardly inclined front wall 17. The upper wall 16 has a front edge which generally extends forwardly and downwardly from the curved portion 8 in a laterally diverging and inclined manner. The front wall 17 expands between the front edge of the upper wall 16 and a lower front edge of the lense frame 6, and has a front surface which faces forwardly and downwardly. An angle Θ, as shown in FIG. 3, defined by the V-shaped cross-section may preferably range from 70° to 120°. As such, the purge valve assembly 4 is constructed such that the inclined front wall 17 slopingly extends from the lower front edge of the lense frame 6, in contrast to a prior art front wall which projects normally forwardly from a body frame. Accordingly, the valve assembly in accordance with the present invention provides a relatively reduced height in the direction projecting forwardly from the body frame of the diving face mask.

The front wall 17 has on its interior central surface area a recessed valve seat 18 which has an oblong open passage 19 (See FIG. 4) in its central area. The open passage 19 is generally aligned with and faces toward a midpoint between the pair of finger-receiving pockets 10. A hollow boss 20 is disposed centrally of the open passage 19. A plurality of arms 21 respectively extend between the boss 20 and a passage wall of the open passage 19 to partition the open passage 19 into a plurality of subpassages. An oblong, flat valve 14, generally made of rubber, sits on the recessed valve seat 18 in a water-tight manner to interrupt or close the open passage 19. The flat valve 14 has a stem 23 (See FIG. 3) which extends through a bore in the hollow boss 20, and a flange 22 on the stem 23 which engages the boss 20 to retain the flat valve 14 in position as shown in FIG. 3. Such an oblong configuration of the flat valve 14 and the opening passage 19 provides reduced bulk and height of the purge valve assembly 4, and accordingly reduces obstruction of the diver's view.

Figure 7:
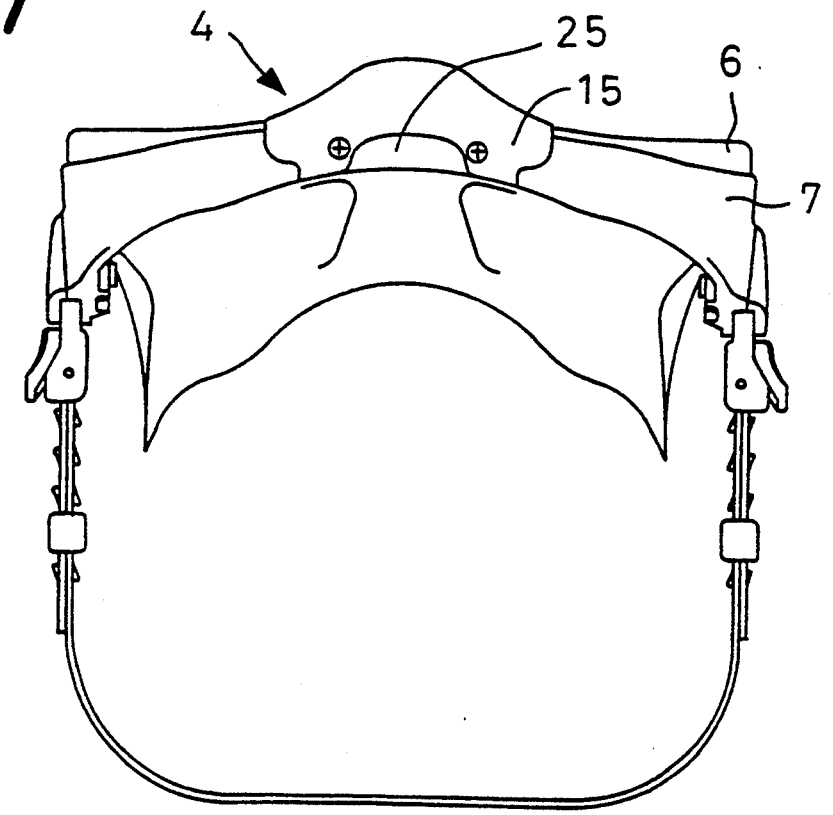
FIG. 7 is a bottom plan view of the diving face mask of FIG. 1.

The nose cover 15 has an overall configuration generally conforming to that of the nose frame 13, and has a forwardly facing arcuate top surface, subject to relatively low fluid resistance, for covering the nose frame 13. In its position to cover the nose frame 13 as illustrated in FIG. 3, a central area of the nose cover 15 is faced against the flat valve 14 to define a space 24 therebetween, and a lower peripheral edge portion of the central area is spaced from respective lower central areas of the inner and outer frames 6, 7 to define an opening passage 25. The nose cover 15 is attached to the nose frame 13 through respective engagement of peripheral projections 26*a* (See FIG. 1) on the nose cover 15 with projection receiving slots (not shown) and projection receiving grooves 26*b* provided along the peripheral edge portion of the nose frame 13. As illustrated in FIG. 7, the nose frame 13 may be fastened to a lower surface of the body frame 1 by screws 31.

The outer frame 7 has in its each lateral side end a strap sleeve 27. A front portion of a strap adjuster 29 to which each end of the strap 5 is coupled is inserted into the strap sleeve 27 and pivotally secured about an axis (not shown) for upward and downward pivotal movement. The strap adjuster 29 has a swivel adjuster base 28.

In the illustrated embodiment, accumulations of water in the face mask move toward and collect in the depression region 11 on the bottom surface of the flexible skirt 3. The provision of the depression region 11 also serves to space a diver's nose from the bottom surface of the flexible skirt 3 for facilitating the diver's breathing from nose. As breath is discharged from the diver's nose, the discharge pressure of the breath forces the accumulations of water to flow in the nose frame 13, and accordingly the valve 14 to move away from the valve seat 18 against the resiliency of the valve 14 and water pressure exerted thereon, so that the opening passage 19 is opened toward the nose cover 15. As a result, breath and the accumulations of water pass through the opening passage 19, and leave the face mask from the discharge opening 25.

As the diver's breath goes through the accumulations of water, air bubbles are formed. Most portions of the air bubbles leave the face mask with the accumulations of water, and some portions remain in the face mask to move into the depression region 11. The discharge pressure of the breath directs those remaining air bubbles to pass through the bubble channel between the respective finger-receiving pockets 10 and the body frame 1, and to move upwardly therefrom along an inner surface of the body frame 1. The bubble channel serves to control such flow of the air bubbles to prevent them from moving toward and diffusing along a rear surface of the lens 2.

When the discharge pressure is released from the valve 14, the valve 14 returns to its initial position to close the opening passage 19 under the action of water pressure exerted thereon and resiliency thereof. Accordingly, water is prevented from flowing into the diving face mask from outside thereof.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover by the appended claims all such modifications as fall within the scope of the claims.

What is claimed is:

1. A diving face mask comprising:

a body frame having a lower edge, and a curved portion upwardly contoured from the lower edge so as to define a contoured interior space for receiving a lens; and a purge valve assembly forwardly projecting from said body frame and comprising a nose frame, a valve and a nose cover, said nose frame being integrally formed with said body frame to forwardly project therefrom, said nose frame having a generally V-shaped cross-section to include a forwardly inclined first wall and a rearwardly inclined second wall intersecting to each other at an angle of from 70 to 120 degrees, said first wall having a front edge forwardly and downwardly extending from said curved portion of the body frame, said second wall extending rearwardly and downwardly from the front edge of the first wall to said lower edge of the body frame, said rearwardly inclined second wall having a valve seat and an opening passage passing through said valve seat, said valve seat being configured to receive said valve in water-tight relationship for closing and opening passage, said nose cover being disposed forwardly of said nose frame and having a forwardly facing arcuate surface configured to generally conform to a configuration of said nose frame for covering a front face of said nose frame, said nose cover having a lower edge spaced from said body frame for defining a discharge opening therebetween.

2. A diving face mask in accordance with claim 1, wherein said body frame comprises an inner frame having said curved portion for receiving said lens, and an outer frame disposed radially outwardly of and engaged with said inner frame, said nose frame being integrally formed with said inner frame to forwardly project from the inner frame, said nose cover having the lower edge spaced from said outer frame for defining said discharge opening therebetween.

3. A diving face mask in accordance with claim 2, wherein said nose cover has an inner surface portion conformable to the shape of said first wall and a peripheral rim portion extending from said inner surface portion, said curved portion of the inner frame having a slot extending along said first wall for detachably receiving said peripheral rim portion of the nose cover.

4. A diving face mask in accordance with claim 1, wherein said opening passage and said valve respectively have a laterally elongated, generally oblong configuration.

5. A diving face mask in accordance with claim 1, wherein said valve seat has a plurality of arms extending into said opening passage so as to support a hollow boss for positioning the hollow boss in substantial alignment with a central axis of said opening passage, said hollow boss having a bore for receiving an central axis steming from said valve.

6. A diving face mask in accordance with claim 1, further comprising:

a flexible skirt extending rearwardly from said body frame, said flexible skirt having on a bottom surface thereof a pair of laterally spaced, integral upward embossments to respectively define finger-receiving pockets into which a diver inserts fingers for pinching a diver's nose.

7. A diving face mask in accordance with claim 6, wherein said flexible skirt has a front peripheral edge portion flanked between respective rear peripheral edge portions of said inner and outer frames.

8. A diving face mask in accordance with claim 6, wherein said flexible skirt has a recessed portion having a V-shaped cross-section between said finger receiving pockets.

9. A diving face mask in accordance with claim 6, wherein said finger receiving pockets are rearwardly spaced from said body frame.

10. A diving face mask comprising:

a body frame having a lower edge;

a nose piece projecting from said body frame, said nose piece having a generally V-shaped cross-section to include a laterally elongated, front side wall forwardly and upwardly extending from said lower edge of the body frame, said front side wall having a laterally elongated generally oblong opening passage;

a laterally elongated, generally oblong valve for closing said opening passage;

a cover element having an edge adjacent to said lower edge of said body frame, a discharge opening disposed between the cover element and the body frame.

11. A diving face mask in accordance with claim 10, wherein said nose piece further comprising a nose cover for covering said front side wall, said nose cover having a lower edge spaced from said lower edge of the body frame for defining said discharge opening therebetween.

12. A diving face mask in accordance with claim 11, wherein said nose cover has a forwardly facing arcuate top surface.

13. A diving face mask comprising:

a body frame configured to define an interior space for receiving a lens;

a purge valve assembly connected to said body frame for discharging accumulations of water and a diver's breath from the diving face mask; and a flexible skirt extending rearwardly from said body frame and having on a bottom surface thereof a pair of laterally spaced, upward projections for defining a space to accommodate a diver's nose therebetween, said flexible skirt further having a recessed portion having a V-shaped cross-section between said upward projections, said upward projections being rearwardly spaced from said body frame to define a bubble channel therebetween.

14. The diving face mask of claim 13, wherein said purge valve assembly projects forwardly from the body frame.

15. The dividing face mask of claim 14, wherein said purge valve assembly has a forwardly facing arcuate top surface.

* * * * *